United States Patent [19]

Gradinger et al.

[11] Patent Number: 4,626,035

[45] Date of Patent: Dec. 2, 1986

[54] APPARATUS FOR MAKING MOPS

[75] Inventors: J. Gary Gradinger, Shawnee Mission, Kans.; Robert W. Quearry, Kansas City, Mo.; Robert D. Chalfant, Atchison, Kans.; Charles G. Wilson, Kearney, Mo.

[73] Assignee: Golden Star, Inc., North Kansas City, Mo.

[21] Appl. No.: 771,021

[22] Filed: Aug. 30, 1985

Related U.S. Application Data

[62] Division of Ser. No. 619,335, Jun. 11, 1984.

[51] Int. Cl.[4] ..... A46D 9/00; A47L 13/20

[52] U.S. Cl. ..... 300/16; 300/1

[58] Field of Search ..... 300/1, 16, 21

[56] References Cited

U.S. PATENT DOCUMENTS

| | | | |
|---|---|---|---|
| 3,309,862 | 3/1967 | Hood . | |
| 3,438,193 | 4/1969 | Kosaka et al. . | |
| 4,275,117 | 6/1981 | Crandall | 428/373 |
| 4,296,597 | 10/1981 | Tani et al. | 57/205 |

*Primary Examiner*—Howard N. Goldberg
*Assistant Examiner*—Timothy V. Eley
*Attorney, Agent, or Firm*—Litman, Day and McMahon

[57] ABSTRACT

A certain process and exemplary machinery for making yarn which is particularly useful for producing mops and mats utilizes yarn generally of a mixture of cotton and certain synthetic fibers and subjects the yarn to heat and pressure. The heat melts the surface of the synthetic fibers and pressure urges the cotton fibers into engagement with the synthetic fibers. Upon cooling, the cotton fibers are mechanically bonded to the synthetic fibers and provide a mop yarn which is fluid absorbant, durable and resistant to scrubbing abrasion and maintains integrity for repeated use and washings.

4 Claims, 12 Drawing Figures

APPARATUS FOR MAKING MOPS

This application is a Division of application Ser. No. 619,335, filed June 11, 1984.

This invention relates to manufacture of mops in general and in particular, to a process and exemplary machine for making a certain yarn for producing mops.

BACKGROUND OF THE INVENTION

The mop industry produces a number of different but related products, among them wet mops, dry or dust mops, hand dusters, and carpet and floor machine buffer pads. All have the predominant characteristic of being composed of a plurality of yarns sewn together in some manner to produce the desired shape for the desired job. Except in the case of wet mops, the yarns are generally sewn to a backing, the form of the backing generally characterizing that article for its intended use.

Some procedures use tufting and in other forms of manufacture, a continuous length of pre-sewn fringe is applied to the backing or in the case of a wet mop, a wide length of pre-sewn fringe is utilized and head bands, tail bands and the like applied as desired. The mops may be made with looped or cut ends as desired by the purchaser. Looped end mops, whether they be wet mops or dust mops, are often desired to prevent excessive linting and pulling apart of the fibers during use. This is a particular problem when less expensive yarns are used, such as those yarns formed of particularly coarse and short staple cotton. The looped end mops are sometimes said to provide superior cleaning abrasion which it is alleged, cut end mops do not. Conversely, advocates of the cut end mops assert the cut end yarns have superior water absorbent qualities through the capillary or wicking action of the cut ends. However, users of the cut end mops have often had a significant problem with linting.

Manufacturers have heretofore experimented with a variety of materials for forming the yarns. Generally, there is a tendency to use low-cost, coarse, short staple cotton fibers but such fibers excessively lint, are slow to dry when washed, and do not maintain integrity long when used. Other manufacturers have tried synthetic fibers but synthetic fibers are significantly more expensive than cotton and usually have little water absorbency for use as wet mops. Dry mops are often treated with an oil to promote pick-up and retention, the synthetic fibers do not hold the oil and the dry mops do not perform well either. Attempts have been made to produce mops using strands of artificial chamois material but such mops are expensive.

Mops are generally used many times during their useful life and are washed and dried between uses. Drying is a particular problem because pure cotton yarns tend to mat when wet; this forms an impervious top layer which prevents heated air from contacting the full lengths of the yarns and a longer time in the dryer must be spent, ultimately increasing the cost of use.

Other products of the mop industry sometimes include entrance and work area mats which are made with various constructions of yarn and fibers. These too are washed frequently and must maintain integrity for repeated use.

In order to overcome the deficiencies of the related mop constructions, the present invention is directed to a particular mop yarn and a process and exemplary machinery for making such yarn and using such yarn to make a mop. The yarn is composed of a combination of staple length fibers of cotton or other absorbent material and a synthetic material which melts at temperatures generally below the burning or charring temperature of the cotton or other absorbent yarn. The fibers are placed in mutual surface engagement, heated and passed over a die which urges the absorbent fibers into the melted surface of the synthetic fibers. Upon cooling, a mechanical bond is created to maintain structural integrity of the yarn and durability and resistance to abrasion. Fluid absorbency of the yarn is substantially unaffected. Preferably, the yarn processing line is part of the production line for mops and is merely a step in the production process. The resultant yarn has excellant suitability for the purpose, may be predyed, and is substantially colorfast for dying or color coding after formation and pursuant to the customer's request.

OBJECTS OF THE INVENTION

The principal objects of the present invention are: to provide a yarn for mops having fluid absorbency, structural integrity and durability and resistance to abrasion; to provide such a yarn which is colorfast for dying; to provide such a yarn which is relatively low in cost; to provide such a yarn which useful for production for many types of mops without significant alterations; to provide a process for making such a yarn which is relatively trouble free and relatively low in cost; to provide such a process which is quick and efficient in use; to provide such a process and machinery therefore which is part of a mop production line; and to provide such a yarn, process and machinery which is relatively inexpensive, sturdy and efficient in use, and particularly well adapted for the intended purpose.

Other objects and advantages of this invention will become apparent from the following description taken in conjunction with the accompanying drawings wherein are set forth, by way of illustration and example, certain embodiments of this invention.

DESCRIPTION OF THE PREFERRED EMBODIMENT

Figure 1:
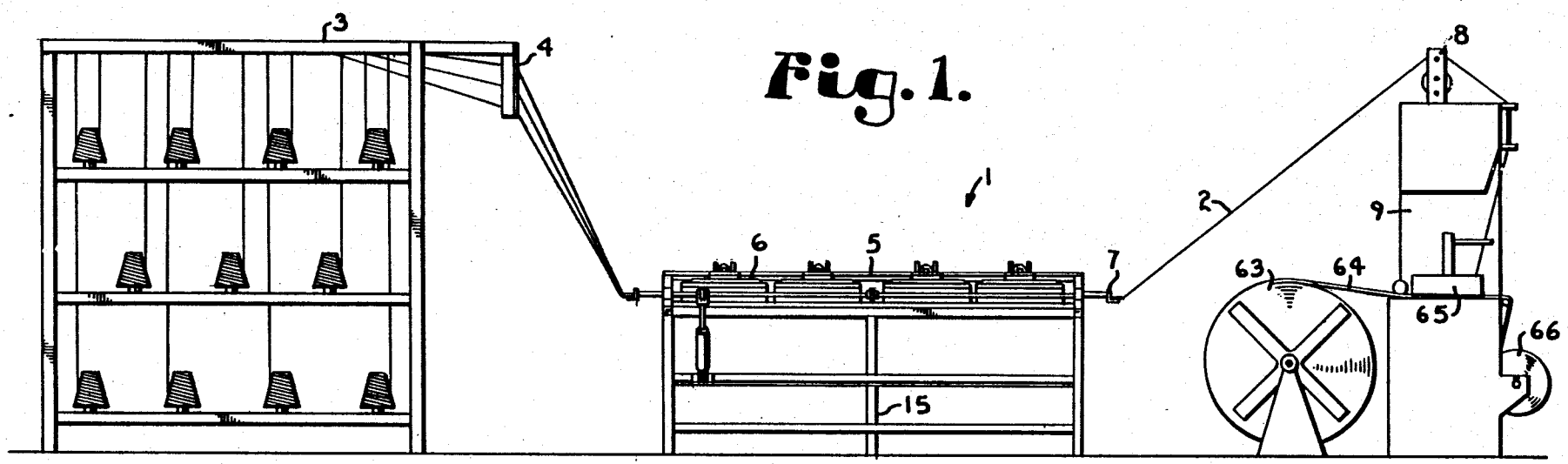
FIG. 1 is an elevational view showing production line machinery for processing and forming yarn embodying the present invention and making mops using the yarn.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The numeral 1, FIG. 1, designates a processing line for strands of yarn 2 embodying the present invention. The yarn 2 is taken from a supply rack 3 and through a first guide means 4 to a processing machine 5. The processing machine 5 includes a heating means 6 and a die means 7 which combine to process the yarn as described below. A second guide means 8 transfers the yarn 2 to a mop making machine 9 wherein it is formed into mats or mops 10, FIG. 2, of various configurations.

The yarn 2 is a composite yarn is formed of at least two different types of fibers. Both are staple length and are not continuous filaments. The staple length fibers may vary from one quarter inch to 7½ inches or more in length. The first type of fiber used is preferably fluid absorbent and may be cotton, rayon or such nonabsorbent fibers as nylon, polyester, or acrylic. When the use is for mops, cotton is particularly beneficial as it is highly fluid absorbent and available in quantities at a relatively low cost although it is not necessary an absorbent yarn be used. The second type of fiber is a synthetic fiber which melts at temperatures below the burning or charring temperature of cotton or the melting point of the first type of fiber. Representatives of this type are Olefin, Polyethylene, Polypropylene or other such fibers. In the preferred embodiment, the first and second types of yarns are respectively cotton and polypropylene.

The staple length fibers are spun either parallel to each other or twisted about together in a garbled or random fashion. Such well known methods of spinning yarns as ring spun, wool spun, and open end spun are all suitable, provided that continuous filament fibers are not used.

The percentage of the second type of fibers, preferably polypropylene relative to the non-meltable fibers such as cotton is from 10% to 30% and particularly 14%. The first type of fiber preferably is one that does not melt, burn or char at temperatures up to the melting point of the surface of the second type of fiber. In the perferred embodiment, the polypropylene yarn melts at about 320°–330° F. depending upon impurities and the cotton yarn will char at about 340°–350° F., depending upon the amount of time the cotton yarn is subjected to these temperatures.

The yarn containing the first and second types of fibers is spun together by a yarn mill and wrapped for shipment on large spools 13, FIG. 1. The spools 13 are placed either singly or together on the supply rack 3, an end of the yarn 2 pulled from the spool 13 and threaded through the first guide means 4. The yarn then proceeds through the processing machine 5.

Figure 6:
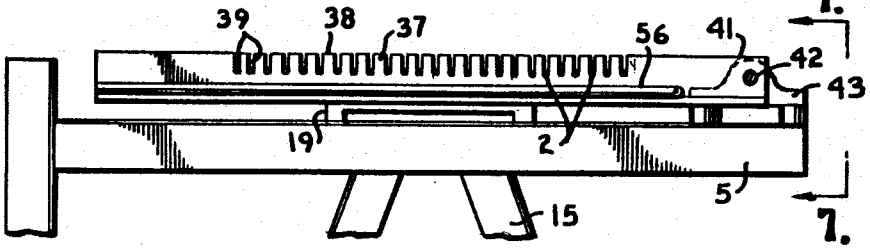
FIG. 6 is an enlarged, side elevational view of the machinery.
Figure 8:
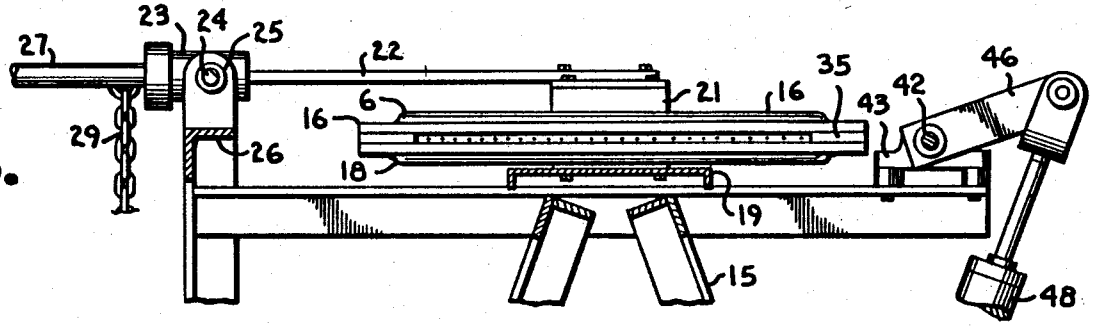
FIG. 8 is a cross-sectional view taken along lines 8—8, FIG. 7.
Figure 9:
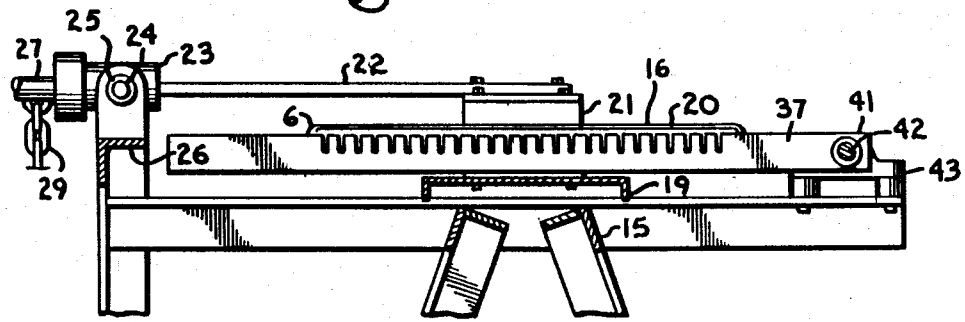
FIG. 9 is a cross-sectional view taken along lines 9—9, FIG. 7.

The yarn processing machine 5 includes the heating means 6 and the die means 7. In the illustrated example, the heating means 6 are hot plates. The processing machine 5 includes a work table 15 positioning the heating means 6 above the floor surface. A series of industrial hot plates 16, such as four in number, are arranged in a row on the work table 15 whereby the yarn 2 passes through each of the hot plates 16. The exemplary hot plates 16 are heated through electrical resistance to approximately 600° F. and each includes a bottom plate 18 mounted to the top of the work table 15 by an insulator 19, FIGS. 6 and 8.

Figure 3:
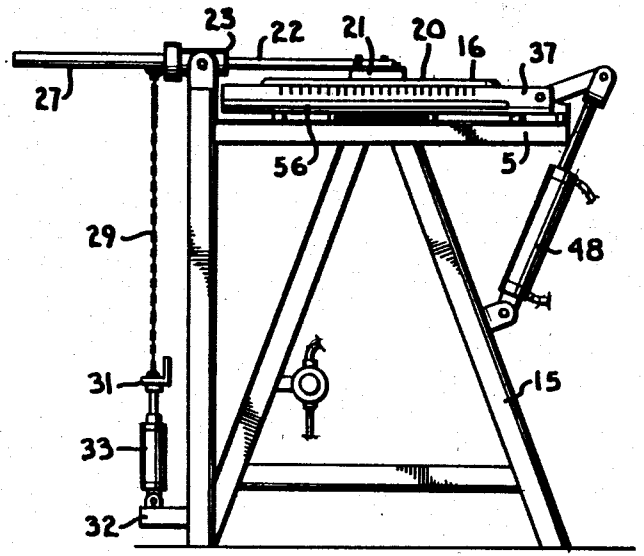
FIG. 3 is an end elevational view of machinery used in the instant process for producing yarn.
Figure 4:
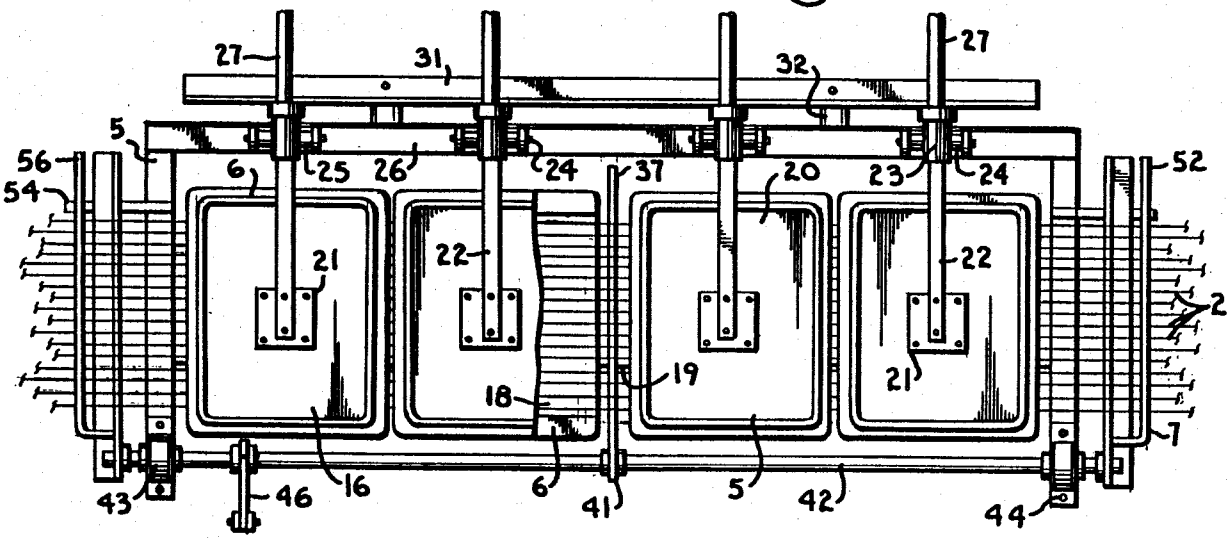
FIG. 4 is a fragmentary, plan view of the machinery.

An upper plate 20 for each of the series of hot plates 16 is mounted through an insulator 21 to a swing arm 22 which extends through a pivot 23 located generally at a mid-portion of the swing arm 22. The pivots 23 have cross pivot shafts 24 rotatably mounted to pillow block bearings 25 in a holder bar 26 extending the length of the work table 15 and positioned generally adjacent the plate 16. Each of the swing arms 22 includes an outer portion 27 extending beyond the pivots 23 and serving as a lever arm. A pull chain 29 is fastened to the swing arm outer portion 27 and has a lower end affixed to an elongate bar 31 extending parallel to the work table 15 and positioned adjacent the floor, FIG. 3.

A support bar 32 is also mounted to the work table 15 and extends parallel and below the bar 31. A pneumatic ram 33 extends between the bars 31 and 32 and when retracted, pulls upon the chain 29 to cause swinging of the pivot arms 22 to lift the upper plates 20 from each of the hot plates 16. This is to prevent burning or scorching of the yarn 2 going through the heating means 6 should there be an interruption in the normal flow of the processing line. As the hot plates normally operate at a temperature of 600° F., the yarn 2 would quickly burn through or melt if allowed to remain in extended contact with the heating means 6.

In the illustrated example, spacer blocks on the bottom plates 18 prevent the upper plates 20 from pinching yarn 2 running between the plates 18 and 20 during use. Preferably, the surfaces of the plates 18 and 20 are coated with a non-stick substance such as Teflon, a product of the DuPont Corporation of Wilmington, Del.

A toothed yarn lift arm 37 is positioned midway on the processing machine 5 such as between the second and third hot plates 16. The yarn lift arm 37 is an elongate bar having a series of dents or teeth 38 with grooves 39 therebetween and when a plurality of the yarns 2 are used, each of the yarns lies in one of the grooves 39. The yarn lift arm 37 is arranged to elevate the yarn 2 from the bottom plates 18 of the hot plates 16 when the normal flow of the process line 1 is interrupted. The swing arms 22 lift the upper plates 20 and the lift arms 37 are sequenced by a pneumatic valve unit (not shown) to swing after the swing arm 22 moves and then remove the yarn from the bottom plates 18 so that the yarn does not burn or scorch through.

Figure 5:
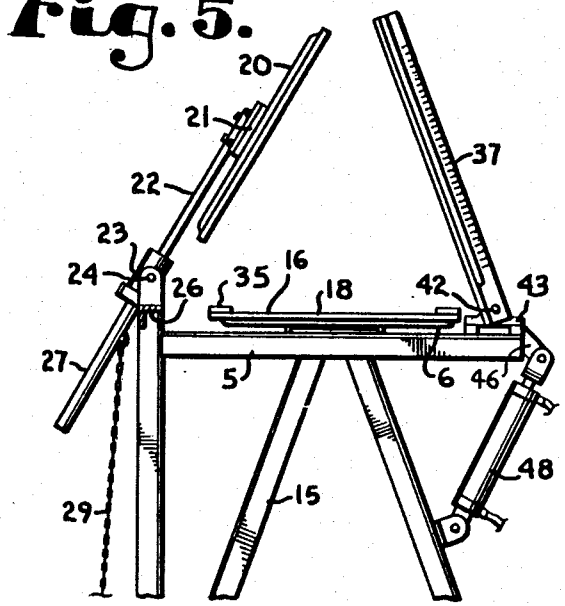
FIG. 5 is a fragmentary, side elevational view of the machinery and showing its operation.

The yarn lift arm 37 has an end 41 positioned oppositely to the swing arm pivot 23 and affixed to a rotating shaft 42. Opposite ends of the shaft 42 are rotatably mounted in pillow block bearings 43 and 44. The lever arm 46 extends outwardly of shaft 42 from adjacent the pillow block bearing 43 whereby when the lever arm 46 is rotated downwardly, FIG. 5, the shaft 42 rotates and the yarn lift arm 37 swings upwardly, carrying the yarn threaded thereon away from the hot plate 16.

A pneumatic ram 48 extends between the lever arm 46 and a leg of the work table 15 and upon retraction, swings the lever arm 46 downwardly.

As the yarns 7 pass through the hot plate 16, they become heated to a temperature of approximately 320° F. to 330° F. During the process set up period, speed of the line is controlled and varied to establish and maintain a 320° F. to 330° F. yarn temperature. At this temperature, the second or synthetic type of fibers such as Polypropylene, of the yarn 2 begin to become surface melted. The mutual engagement or contact between the non-melting fibers and those with surface melting, permits the slightly melted fibers to flow somewhat about the non-melting fibers, and when cooled, the melted portions exert a strong mechanical bond or hold upon the unmelted fibers. As these non-melted fibers are preferably of a material like cotton, the cotton therefore does not tend to lint or pull apart and slough off in the manner of previous all cotton or blended cotton and synthetic yarns not having undergone the present process.

When heated, not all of the second fibers become surface melted. Rather, only those fibers on the exterior of the yarn cord 2 generally surface melt and bond to the interposed first fibers. This is because heat is applied to the exterior of the yarn cord and generally does not transfer to the cord interior before the exterior fibers are heated to the desired temperature such as 320° F. to 330° F.

Figure 7:
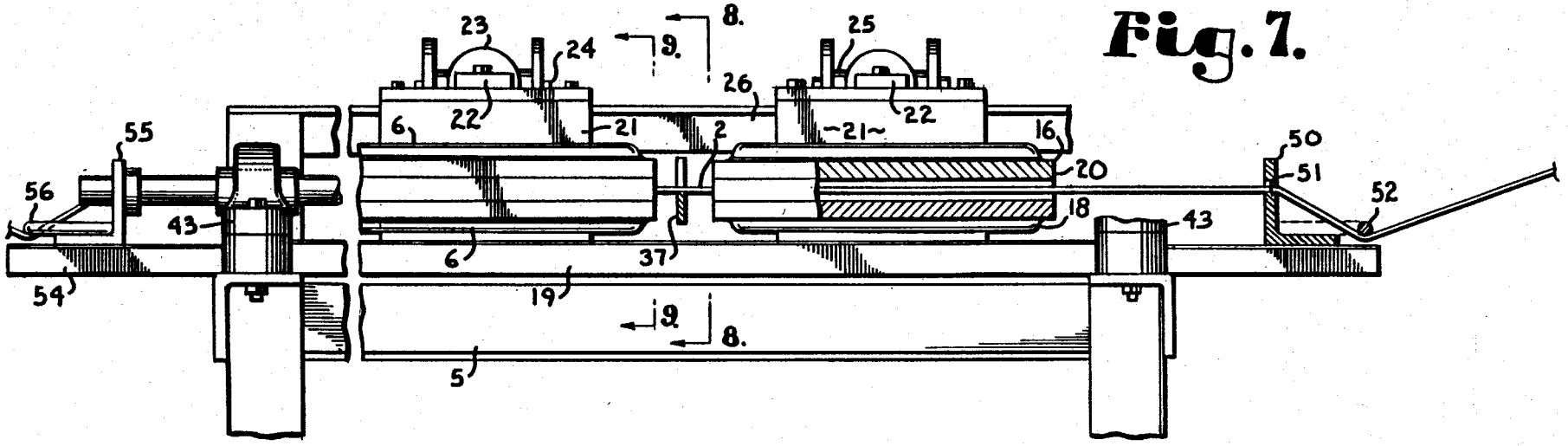
FIG. 7 is a longitudinal sectional view taken along line 7—7, FIG. 6.

To exert pressure on the heated yarns to push the cotton fibers into mechanical bonding relationship with the surface melted synthetic fibers, die means 7 are positioned at the outlet end of the processing machine 5. In the illustrated example, FIG. 7, the die means 7 are formed of a length of angle iron 50 extending transversely to the direction of travel of the yarn 2 and having a series of bores through which the yarn 2 is threaded. A holder rod 52 is positioned downwardly from the angle iron 50 and the yarn 2 threaded under the holder rod 52 causes two angular changes in direction of the yarn 2. As the yarn 2 exits the bores 51, pressure is exerted by the bore periphery and as it travels about the holder rod 52, additional pressure is exerted on it by the rod. The pressure urges the yarn fibers together and as the tacky synthetic fibers cool, the cotton or non-melting fibers become bonded to the freshly melted fibers. To position the yarns 2 properly for passage through the plates 16, the inlet end 54 of the processing machine 5 has a similar arrangement of angle iron 55 and holder rod 56. These of course cause the yarn to change angular direction but because the yarn has not been heated at this point, they do not function to urge the fibers together to mechanically bond.

Figure 10:
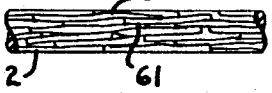
FIG. 10 is an enlarged, fragmentary view of a yarn made according to the present invention.

FIG. 10 illustrates in exaggerated form the bonding of the surface melted synthetic fibers 60 with the non-surface melted fibers 61. Bonds are formed wherever the melted or tacky surfaces of the synthetic fibers touch other fibers. This creates a durable fiber which when being used to scrub or otherwise clean surfaces, the fibers will not pull apart or slough off. When the yarn is cleaned, the fibers do not tend to pull apart. Similarly, when subjected to friction or turbulence, the fibers tend to hold together; for this reason, the yarn lasts longer and provides the owner more utilization for the investment.

Although the fibers are bonded wherever they touch the partially melted synthetic fibers, there are many open interstices within the yarn cord 2. These permit the passage and circulation of air, water, oil and other agents used in treating, cleaning, drying or otherwise processing yarn. The yarn cords are moderately soft because of the open interstices and the bonding permits each yarn cord in a lot to maintain its own identity and not mat together with its neighbors, even when the cord ends are cut.

Figure 2:
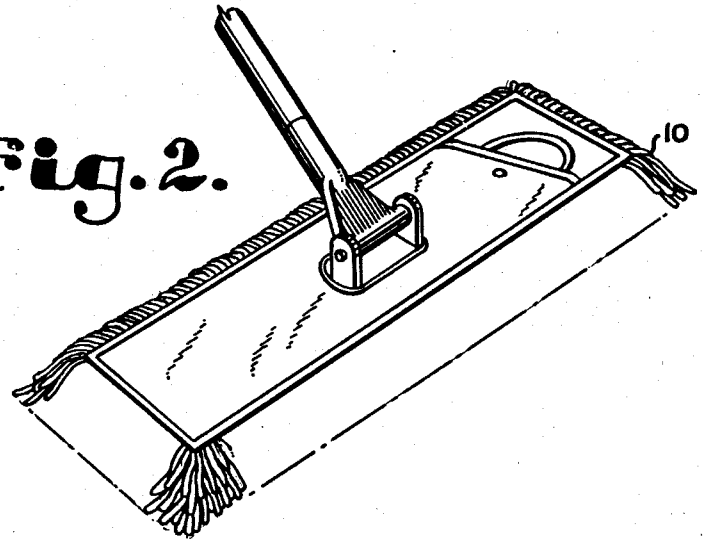
FIG. 2 is a perspective view of a dry mop made using the subject yarn.

When formed into a mop, such as the dust mop shown in FIG. 2, the yarn does not tend to mat together in a mass on the surface of the mop and each yarn cord remains separate to attract dust or other particulate matter all over its surface and not just on a matted end. These particles are collected among the various cords, causing the mop to be able to pick up more particles before requiring cleaning. Moreover, the mop can be cleaned faster and more efficiently because the cleaning agents can circulate more freely among the cords because the cords do not tend to mat down. Similarly, a mop 10 can dry faster because air can circulate above the yarn cords and among the interstices within each yarn more efficiently. The air also reaches the fabric backing in large quantity because of the open spaces among the cords. Energy is saved and direct costs and overhead are reduced because of the shorter cleaning and drying time. Oil may be used to treat the yarn to increase its dust attraction, and the oil will be applied more evenly because more yarn cord surface will be exposed.

Figure 12:
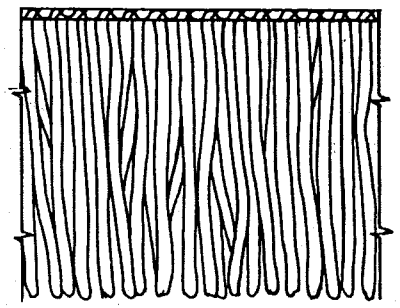
FIG. 12 is an enlarged, fragmentary plan view of a mop made with the yarn of the present invention.
Figure 11:
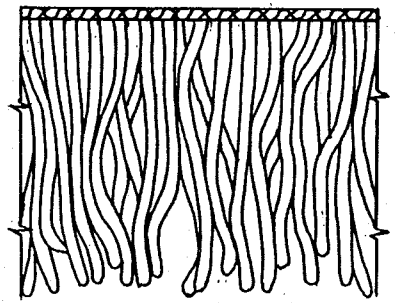
FIG. 11 is an enlarged fragmentary plan view of the underside of a mop using previous yarn constructions.

Examples of the aforementioned new and old mop fibers are shown in connection with FIGS. 11 and 12. FIG. 11 shows a surface of a mop using the previous fibers and which has become matted and the cut tip ends of the yarns have bloomed, that is expanded and are beginning to lint off. These bloomed fibers form an impenetrable mat which causes a reduction in the cleaning and absorbing power of the mop.

FIG. 12 illustrates an example of a mop made with the yarn 2 of the present invention. After repeated washings, the cut tip ends have not bloomed to any appreciable extent and each fiber remains open for circulation of air, cleaning power and water absorbency.

As a final step in the process line 1, the bonded yarn 2 proceeds to the mop making machine 9, FIG. 1. This machine may be a tufting machine or may be a pre-sewing machine. In the case of a tufting machine, a reel 63 of backing material 64 is mounted behind the machine 9 and the yarn 2 is passed through a tufting head 65. Thereafter, a roll of tufted backing 66 is taken up at the foot end of the machine 9. In the case of a pre-sewing machine, the machine 9 is arranged so that the head 65 is a pre-sewing head with spaced arms extending outwardly to wrap the yarn 2 about the arms and with appropriate chains, belts and the like to drive the pre-sewn yarn off the arms. These machines use a winding arm which rotates around a pair of traveling arms. As the yarn is wrapped about the traveling arms, chains or other drive means carry the wrapped yarn toward and off the ends of the traveling arms and through a stitching head where, typically, the wrapped yarn is collapsed in the middle and stitched together. The reel 63 would hold a large quantity of pre-sewn fringe for later use.

It is to be understood that while certain forms of the present invention have been illustrated and described herein, it is not to be limited to the specific forms or arrangement of parts described and shown.

What is claimed and desired to be secured by Letters Patent is as follows:

1. A mop making machine comprising:

(a) a yarn feeder means for pulling yarn from a spool thereof;

(b) a first guide means for directing said yarn from said feeder means;
(c) a heater means for heating said yarn to approximately 320° F. to 330° F.;
(d) a die means associated with said heater means for pressing upon said yarn and urging heated fibers of said yarn together;
(e) a second guide means for directing said yarn from said heater means and said die means; and
(f) a tufting apparatus receiving said yarn from said second guide means; said tufting apparatus having a backing reel therewith carrying backing material and sewing means for affixing said yarn to said backing material.

2. A mop making machine comprising:
(a) a yarn feeder means for pulling yarn from a spool thereof;
(b) a first guide means for directing said yarn from said feeder means;
(c) a heater means for heating said yarn to approximately 320° F. to 330° F.;
(d) a die means associated with said heater means for pressing upon said yarn and urging heated fibers of said yarn together;
(e) a second guide means for directing said yarn from said heater means and said die means; and
(f) a fringe sewing apparatus receiving said yarn from said second guide means; said fringe sewing apparatus having a rotary sewing head and means for making a pre-sewn fringe and a storage means therewith for said pre-sewn fringe.

3. A mop making machine assemblage comprising:
(a) a yarn feeder means for pulling yarn from a spool thereof;
(b) a first guide means for directing said yarn from said feeder means;
(c) a heater means for heating said yarn;
(d) a die means associated with said heater means for pressing upon said yarn and urging heated fibers of said yarn together;
(e) a second guide means for directing said yarn from said heater means and said die means; and
(d) a tufting apparatus receiving said yarn from said second guide means; said tufting apparatus having means therewith carrying backing material and sewing means for affixing said yarn to said backing material.

4. A mop making machine assemblage comprising:
(a) a yarn feeder means for pulling yarn from a spool thereof;
(b) a first guide means for directing said yarn from a spool thereof;
(c) a heater means for heating said yarn;
(d) a die means associated with said heater means for pressing upon said yarn and urging heated fibers of said yarn together;
(e) a second guide means for directing yarn from said heater means and said die means; and
(f) a fringe sewing apparatus receiving said yarn from said second guide means; said fringe sewing apparatus having means for forming a pre-sewn fringe and storing means associated therewith for said fringe.

* * * * *